United States Patent [19]

Webb et al.

[11] 4,109,736

[45] Aug. 29, 1978

[54] DOUBLE ACTING JAR

[76] Inventors: Derrel D. Webb, 802 Axilda, Houston, Tex. 77017; Edwin A. Anderson, 1104 Chimney Rock Rd., Houston, Tex. 77056

[21] Appl. No.: 782,011

[22] Filed: Mar. 28, 1977

Related U.S. Application Data

[63] Continuation-in-part of Ser. No. 694,911, Jun. 11, 1976, abandoned.

[51] Int. Cl.[2] ..... E21B 1/10

[52] U.S. Cl. ..... 175/297; 175/304

[58] Field of Search ..... 175/296, 297, 304, 301

[56] References Cited

U.S. PATENT DOCUMENTS

| | | | |
|---|---|---|---|
| Re. 23,354 | 4/1951 | Storm | 175/297 |
| 2,659,576 | 11/1953 | Linney | 175/297 |
| 3,005,505 | 10/1961 | Webb | 175/297 |
| 3,209,843 | 10/1965 | Webb | 175/297 |
| 3,221,826 | 12/1965 | Webb | 166/178 |
| 3,566,981 | 3/1971 | Love | 175/297 |
| 3,853,187 | 12/1974 | Sutlift et al. | 175/297 |
| 3,949,821 | 4/1976 | Raugust | 175/297 |
| 3,955,634 | 5/1976 | Slator et al. | 175/297 |
| 3,987,858 | 10/1976 | Slator et al. | 175/297 |

*Primary Examiner*—James A. Leppink

*Attorney, Agent, or Firm*—Jack W. Hayden

[57] ABSTRACT

A double acting jar includes inner and outer telescopically arranged tubular parts movable longitudinally, but nonrotatable relative to each other. Cooperating means on the inner and outer telescopically arranged tubular parts deliver an upward jaw to a stuck drill string upon relative longitudinal movement of the inner and outer telescopically arranged tubular parts in one direction and deliver a downward jar to a stuck drill string upon relative longitudinal movement of the inner and outer telescopically arranged tubular parts in the other direction. The cooperating means is constructed and arranged to be disengaged and maintained in an inoperative relationship when the drill string is in tension and compression during rotary drilling operations. When the jar is effected by a hydraulic jarring arrangement, fluid meter means incorporates a temperature responsive, compensating means to maintain substantially uniform flow rates through the metering means at varying temperature conditions. An overloading valving arrangement prevents overloading of the hydraulic jar and enables it to unload prior to damage to the jar tool. The jar is constructed and arranged so that the magnitude of the upward or downward impact may be readily and substantially automatically varied while the tool is in the well bore.

33 Claims, 16 Drawing Figures

DOUBLE ACTING JAR

CROSS REFERENCE TO RELATED APPLICATION

The present invention is an improvement over the invention described in our application Ser. No. 571,093 filed on Apr. 24, 1975 for "Double Acting Mechanical Jar", now U.S. Pat. No. 3,963,081. The application is a continuation-in-part of our prior copending application Ser. No. 694,911 filed June 11, 1976 for "Double Acting Jar", now abandoned.

DESCRIPTION OF THE PRIOR ART

The prior art with which applicant is familiar is as follows: U.S. Pats. Nos. 3,880,249; 3,221,826; 2,987,129; 2,013,127; 2,059,540; 2,891,772; 3,050,131; 3,208,541; 3,233,690; 3,685,598; 3,685,599 and 3,987,858.

SUMMARY OF THE INVENTION

Various type jars have been provided and are in use that are adapted to be incorporated in a drill string during drilling operations so that either an upward jar or impact or a downward jar or impact may be applied to the drill string when needed.

In addition, the devices with which applicants are familiar for imparting upward and downward jarring forces to a stuck drill string comprise two separate tools one of which is an up jar, and one of which is a down jar, each of which, of necessity, must have its own separate operating mechanism that functions independently of each other.

Also, the jarring mechanisms presently in use with which applicants are familiar are constructed and arranged so that when the drilling string is rotated during drilling operations while in tension or compression, such jarring mechanisms are in "detent" position. That is, the mechanism to impart the jar is engaged and in a position ready to be actuated. Such construction is disadvantageous in that when the drill string is rotated during normal rotary drilling operations with the jarring mechanism in such relationship over a period of time, the jarring mechanism may malfunction or not function at all when it is desired to impart a jar to the drill string.

Also, as a well bore is drilled progressively deeper into the earth, the temperature in the well bore increases and when hydraulic jars are employed in drill strings, the hydraulic fluid temperature increases with well bore depth. Repeated use of the hydraulic jar even at well bore depths where the temperature is not increased may in and of itself cause an increase in temperature in the hydraulic fluid. A change in temperature in the hydraulic fluid affects the viscometric characteristics of the hydraulic fluid so that the tool will not operate uniformly in the manner intended.

Additionally, it is difficult, if not impossible to vary the jarring load applied to the drill string while the tool is in use in the well bore. Most jars with which applicants are familiar are preset at the earth's surface to operate or jar at a fixed load. Aside from the fact that such jarring load or force may change due to temperature conditions in the well bore, there may be instances where the operator of the jar desires to apply either a greater or a lesser jarring force to the well string while the tool is in the well bore, and without the necessity of removing the jar from the well bore, or the necessity of application of extraordinary forces to the drill string to effect a change in the jar load or force.

One of the primary objects of the present invention is to provide a jar for a drill string which incorporates means for applying an upward jar to a drill string and a means for applying a downward jar to the drill string which means are combined in a single tool, and which means may be selectively actuated to apply either an upward jar or a downward jar to the stuck drill string or any combination of upward and downward jars to the stuck drill string as desired, as well as varying the jar load to the stuck drill string, and wherein the tool is constructed and arranged so that its jarring mechanism will remain disengaged while the drill string is in tension or compression as the drill string is rotated during normal rotary drilling operations.

Another object of the present invention is to provide a fluid meter means in a hydraulic jar for use in a drill string for metering fluid from one side of a piston and cylinder arrangement to the other side of the piston in one direction and includes means to compensate for temperature changes in the hydraulic fluid in the cylinder to maintain the fluid flow rate of the fluid metered substantially uniform at varying temperatures of the fluid and additional means also provided for bypass in the other direction.

Yet a further object of the present invention is to provide in a hydraulic jar arrangement a temperature compensating fluid meter arrangement for metering fluid from one side of the piston and cylinder to the other side of the piston and cylinder and which is responsive to changes in temperature to vary the size of the fluid meter means to maintain the fluid flow rate through the meter means substantially uniform at varying temperatures of the fluid.

Yet a further object of the present invention is to provide in a hydraulic jar arrangement a temperature compensating fluid meter arrangement for metering fluid from one side of the piston and cylinder to the other side of the piston and cylinder and which is responsive to changes in temperature to vary the size of the fluid meter means to maintain a uniform fluid flow rate regardless of temperature changes in the fluid, and an overload check valve arrangement which is adapted to open at a predetermined hydraulic pressure so as to bypass fluid from one side of the cylinder and piston arrangement to the other side of the cylinder and piston arrangement when a predetermined hydrostatic pressure is reached on the one side of the cylinder and piston arrangement.

A further object of the present invention is to provide a jar for a drill string which incorporates means for applying an upward jar to a stuck drill string and a means for applying a downward jar to a stuck drill string which means are combined in a single tool, and which means may be selectively actuated to apply either an upward jar or a downward jar to the drill string or any combination of upward and downward jars to the drill string as needed and wherein the tool is constructed and arranged so that its jarring mechanism will remain disengaged while the drill string is in tension or compression as the drill string is rotated during normal rotary drilling operations. The up and down jarring mechanisms that are combined in a single tool have inner and outer parts telescopically arranged and constructed to impart the up jar as well as the down jar to a stuck drill string.

A further object of the present invention is to provide a jar for a drill string which incorporates means for applying an upward jar to a stuck drill string and a means for applying a downward jar to a stuck drill string which means are combined in a single tool, and which means may be selectively actuated to apply either an upward jar or a downward jar to the stuck drill string or any combination of upward and downward jars to the stuck drill string as desired and wherein the tool is constructed and arranged so that its jarring mechanism will remain disengaged while the drill string is in tension or compression as the drill string is rotated during normal rotary drilling operations. The up and down jarring mechanisms which are combined in a single tool have inner and outer parts telescopically arranged and constructed to impart the up jar as well as the down jar to the well string with the up jar being a hydraulic jar and the down jar being a mechanical jar.

A further object of the present invention is to provide a jar for a drill string which incorporates means for applying an upward jar to a stuck drill string and a means for applying a downward jar to a stuck drill string which means are combined in a single tool, and which means may be selectively actuated to apply either an upward jar or a downward jar to the stuck drill string or any combination of upward and downward jars to the stuck drill string as desired and wherein the tool is constructed and arranged so that its jarring mechanism will remain disengaged while the drill string is in tension or compression as the drill string is rotated during normal rotary drilling operations. The up and down jarring mechanisms which are combined in a single tool have inner and outer parts telescopically arranged and constructed to impart the up jar as well as the down jar to the stuck drill string with the up and down jar mechanisms both being hydraulic jars.

A further object of the present invention is to provide a jar for a drill string which incorporates means for applying an upward jar to a stuck drill string and a means for applying a downward jar to the stuck drill string which means are combined in a single tool, and which means may be selectively actuated to apply either an upward jar or a downward jar to the stuck drill string or any combination of upward and downward jars to the stuck drill string as desired and wherein the tool is constructed and arranged so that its jarring mechanism will remain disengaged while the drill string is in tension or compression as the drill string is rotated during normal rotary drilling operations. The up and down jarring mechanisms are combined in a single tool having inner and outer parts telescopically arranged and constructed to impart the up jar as well as the down jar to the stuck drill string with the up and down jar mechanisms being hydraulic jars, the hydraulic jars each having a piston and cylinder arrangement with a fluid meter arrangement for metering fluid from one side to the other side of each piston and cylinder arrangement and which meter arrangement is responsive to changes in temperature to vary the size of the fluid meter to maintain uniform fluid flow rate therethrough regardless of temperature changes, and an overload check valve arrangement which opens at a predetermined hydraulic pressure so as to bypass fluid from one side of the cylinder and piston arrangement to the other side of the cylinder and piston arrangement when a predetermined hydrostatic pressure is reached on the one side of the cylinder and piston arrangement.

Yet a further object of the present invention is to provide a double acting hydraulic jar which may impart either an upward jar or a downward jar to a stuck drill string as well as any combination of upward or downward jars to the stuck drill string and which is constructed and arranged so that the jarring load may be varied selectively while the tool is in the well bore.

Yet a further object of the present invention is to provide a double acting hydraulic jar which may impart either an upward jar or a downward jar to a stuck drill string as well as any combination of upward or downward jars to the stuck drill string and which is constructed and arranged so that the jarring magnitude may be readily and substantially automatically varied while the tool is in the well bore. The jar includes pressure equalizing means to equalize pressure in the jar with ambient pressure in the well bore in a manner which does not interfere with functioning of the double acting hydraulic jar and does not limit the magnitude of the jarring force.

Other objects and advantages of the present invention will become more readily apparent from a consideration of the following drawings and description.

DESCRIPTION OF THE PREFERRED EMBODIMENT

Figure 1:
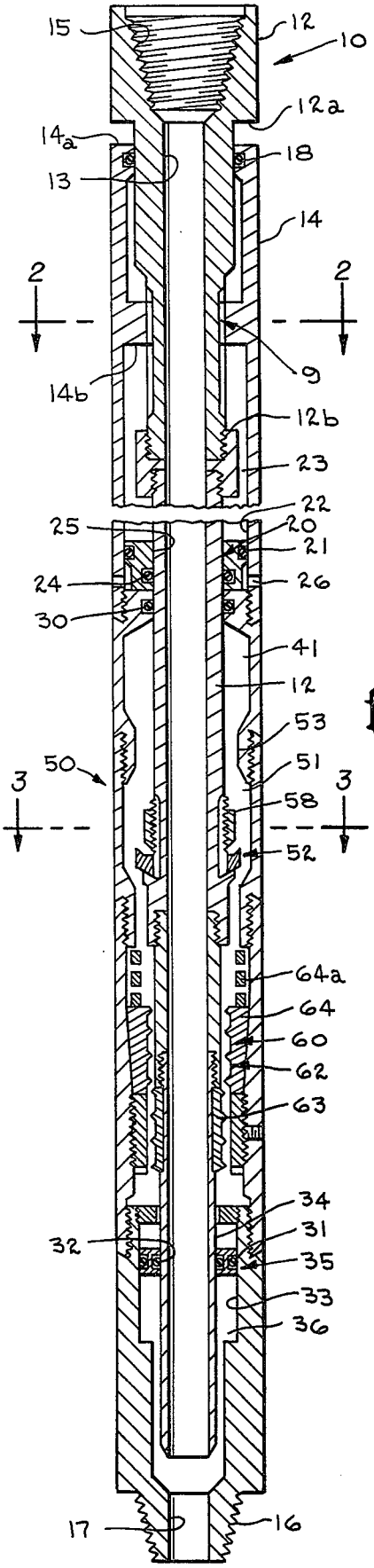
FIG. 1 is a longitudinal sectional view of one form of the tool showing the up and down jar mechanisms in an inoperative position and disengaged during normal rotary drilling operations while the drill string is in tension or compression.
Figure 2:
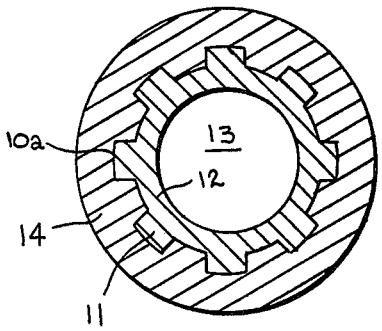
FIG. 2 is a sectional line on the line 2—2 of FIG. 1.
Figure 3:
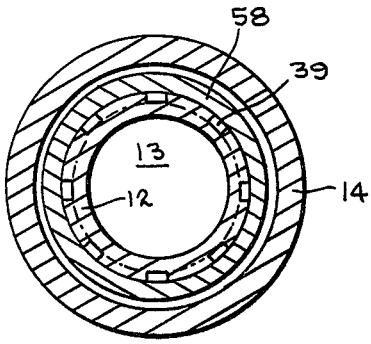
FIG. 3 is a sectional view on the line 3—3 of FIG. 1.

Attention is first directed to FIG. 1 of the drawings wherein the tool of the present invention is referred to generally by the numeral 10. An inner part or mandrel 12 is shown as being telescopically received within and extending longitudinally of an outer part or housing 14. Suitable means such as threads 15 are provided at one end of the inner part 12 and threads 16 on the lower end of the outer part or housing 14 are provided for enabling the tool of the present invention to be engaged in a drill string or well string (not shown). The inner part 12 is provided with a bore 13 extending longitudinally therethrough which communicates with the opening 17 through the lower end of the housing 14 so that drilling fluids may be discharged through the drill string and through the tool 10 of the present invention during rotary drilling and other well bore operations as may be desired.

Suitable seal means 18 are provided adjacent the upper end of the outer housing 14 for sealably engaging between the outer part 14 and inner part 12 to inhibit entry of well fluids into the tool 10 and to seal off hydraulic fluids within the tool from well bore fluids. A floating piston seal means 20 is provided with a seal 21 which engages the inner annular wall 22 of the outer part 14 in the chamber portion 23 as shown in the drawings. A seal ring 24 is provided adjacent the opening 25 in the piston seal means 20 and sealably engages with outer surface 34 of inner part 12 as shown in FIG. 1 of the drawings. Port means 26 in the outer part 14 are provided for communicating well bore fluid internally of the chamber 23 to act on the floating piston seal means 20 so that the internal pressure within the tool and well bore pressure may be equalized without commingling of well bore fluids and fluids in the tool.

Additional seal means 30 are provided in the outer housing 14 beneath the chamber portion 23 that sealably engages with the inner part 12 as shown. The seal means 30 along with the floating piston seal means referred to at 35 arranged in the chamber portion 36 adjacent the lower end of the outer part 14 and inner part 12 define a hydraulic fluid receiving chamber therebetween referred to at 40.

It will be noted that the floating piston seal means 35 is provided with seals 31 and 32 on its outer and inner circumferential edges which engage respectively the inner annular wall 33 of the chamber 36 and the outer surface 34 of the inner part 12. The lower end of chamber 36 beneath floating piston 35 is communicated with the well bore through the opening 17 and well bore pressure may thus act on the floating piston seal means 35 to again equalize pressure internally and externally of the tool 10 during its use in the well bore.

The inner part 12 and outer part 14 are movable longitudinal relative to each other but are restrained against relative rotation by reason of the spline arrangement referred to generally at 9, which includes a plurality of circumferentially spaced grooves 10*a* on the outer housing or part 14 in which are engaged a plurality of longitudinally extending ribs 11 extending longitudinally of the inner part 12.

The inner part 12 is provided with shoulder means at 12*a* and 12*b* and the outer part 14 is provided with shoulder means at 14*a* and 14*b*. When a downward jar is applied to the drill string or well string the shoulder means 12*a* and 14*a* will be impacted to deliver the downward jar and when an upward jar is delivered to the well string or drill string by the present invention the shoulder means 12*b* and 14*b* will be impacted to deliver an upward jar to the rotary drill string or well string in which the present invention is employed.

In FIG. 1 the jarring means or arrangement for applying an up jar or impact to the drill string in which the present invention is connected is shown as being accomplished by means of a hydraulic jar referred to at 50 of any suitable construction and arrangement, one form of which will be described in greater detail herein.

In the FIG. 1 embodiment, the arrangement for delivering a downward jar comprises a mechanical jar means referred to generally at 60 and which may be constructed and arranged as described in our copending application Ser. No. 571,093 filed on Apr. 24, 1975 now U.S. Pat. No. 3,963,081.

Figure 6:
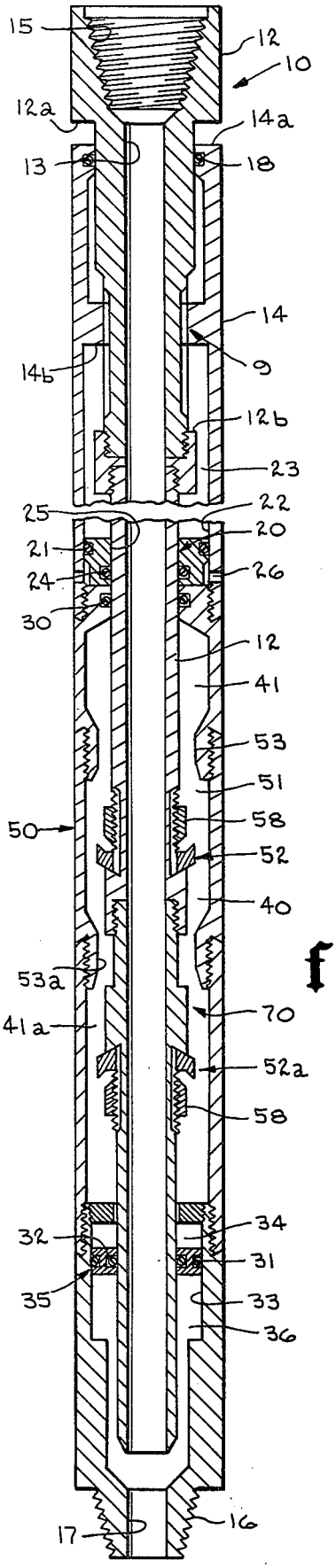
FIG. 6 is a longitudinal sectional view illustrating an alternate embodiment of the present invention.

In the FIG. 6 embodiment of the present invention, like numerals refer to like parts, and it will be noted that the tool there illustrated is identical to that illustrated in FIG. 1 with the exception that a hydraulic jar means 70 has been substituted for the mechanical jar means 60 to impart a downward jar to the rotary drill string, such hydraulic jar means 70 being identical but reversed in construction and function to the hydraulic up jar means 50 shown in FIGS. 1 and 6.

The hydraulic jar means 50 includes the cylinder means formed within part 14 and referred to generally at 51 which is adjacent the upper end of hydraulic fluid receiving reservoir 40 formed within the outer housing 14 between the seal means 30 and 35 as previously described. Piston means referred to generally at 52 is formed on the inner part or mandrel 12 and is adapted to sealingly engage with the reduced portion 53 of the cylinder means 51 in hydraulic reservoir 40 when the mandrel 12 is pulled up to thereby apply pressure to the substantially noncompressible fluid in the cylinder portion 41 on one side of the cylinder 51 and piston means 52.

Figure 4:
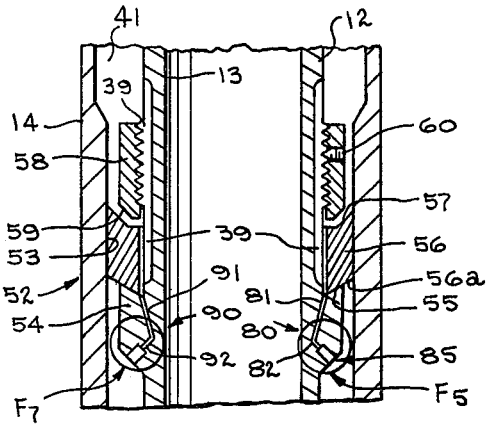
FIG. 4 is an enlarged view of a preferred form of the piston arrangement when a hydraulic jar is employed with the invention.

The details of the piston means 52 are shown and described in U.S. Pat. No. 3,221,826 and comprises an annular flange 54 on the inner part 12 which inner part 12 is in effect a piston rod. The outer diameter of the annular flange 54 is less than the inner diameter of the reduced portion 53 of the cylinder 51. The upper end of the flange 54 provides an annularly disposed tapered shoulder 55 which serves to support the lower tapered end 56*a* of the piston ring 56 which ring is slidable on inner member 12 as shown in FIG. 4. The piston ring may be formed of any suitable resilient material and in the upper end thereof, there is provided a tapered, upwardly opening recess 57 as shown in FIG. 4 of the drawings.

A plurality of circumferentially spaced longitudinally extending slots 39 are provided on the inner part 12 extending from the annular flange 54 upwardly and longitudinally for a distance as shown in the drawings. A retaining nut 58 is threadedly engaged on the inner part 12 and is positioned between the ends of the circumferentially spaced slots 39 as shown. The nut 58 is provided with a lower tapered end 59 which generally conforms with the tapered upwardly opening recess 57 formed on the slidable piston ring 56. A suitable set screw 60 is provided for locking the nut 58 in position on the inner part 12.

The piston ring 56 is disposed or extends outwardly radially relative to the retaining nut 58 and flange 54 to forcibly engage the interior surface of the reduced portion 53 when the inner part 12 is moved longitudinally relative to the outer part 14 to position the piston means 52 adjacent the reduced portion 53 of the cylinder 51. As the inner part 12 is pulled upwardly in the FIG. 1 form, the piston ring 56 seats on shoulder 55 and forcibly engages the surface of reduced portion 53*a*. Fluid flows from cylinder portion 41 through passages 39 and to passages 81 and 91. The piston retaining nut 58 restricts vertical movement or travel of the piston ring 56 on the inner part 12 during movement of the piston ring 56 when inner part 12 is moved in an opposite direction. The passages 39 communicate with the circumferentially spaced passage means referred to at 80 in the flange 54 to bypass fluid from one side of the piston 52 to the other. A plurality of other circumferentially spaced passage means referred to generally at 90 are also communicated with the passages 39 for a purpose as will be described.

Figure 5:
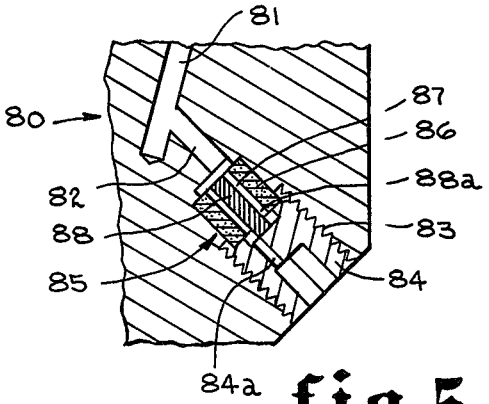
FIG. 5 is an enlarged view of that portion of FIG. 4 which is circled.

The details of the passage means 80 is shown in FIG. 5 and includes passages 81 and 82 which communicate with each other, with the passages 81 communicating with passages 39 as shown in FIG. 4. Orifice means referred to generally at 85 are provided in the passage means 80 and form part of such passage means. Such orifice means includes a cylindrical member 86 having a central passage 87 therethrough in which is received the member 88 of a smaller diameter than central passage 87. The circumferential opening 88*a* between passage 87 and member 88 forms a fluid flow path or means for the fluid to be metered. The outer portion of passage means 82 is counterbored as illustrated at 83 and is threaded to receive the plug 84 having the passage means 84*a* therethrough communicating with the passage 88*a* between the cylindrical member 86 and member 88.

Figure 7:
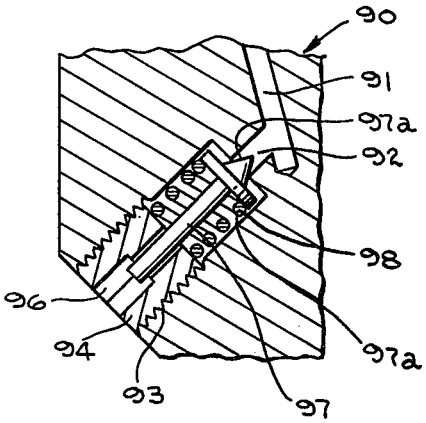
FIG. 7 is an enlarged partial sectional view of that portion of FIG. 4 which is circled.

The passage means 90 is shown in greater detail in FIG. 7 and includes passages 91 and 92 which communicate with each other, the passage 91 communicating with the passages 39 as shown in FIG. 4. The lower end of passage 92 is again enlarged and threaded as shown at 93 for receiving the retaining member 94 therein having passage means 96 therethrough for communicating with the passage 92. A spring loaded plunger 97 is provided in the passage 97*a* retaining member 94 and functions as a check valve to normally close off flow between 91 and 96. It is supported in position by the spring 98, and the check valve is retained in position by the spring 98, and such spring may be of suitable strength so as to retain the seat 97*a* of plunger 97 in seated position on the end of passage 92 until a predetermined hydrostatic pressure has been built up in the chamber portion 41 on one side of the cylinder and piston means.

While it is believed that the operation of the hydraulic jar employed with the present invention is apparent by reason of the foregoing, it can be appreciated that when the inner part 12 is moved longitudinally, the piston ring 56 will sealably engage with the reduced portion 53 thus causing a pressure to build up in the incompressible fluid in the cylinder portion 41 above the piston means 52. The amount of hydrostatic pressure created will depend upon the amount of pull on inner part 12 in relation to time and will thus cause a predetermined amount of stretching in the drill string which is connected to part 12 and thus forms part of the drill string.

As fluid is metered through the passage or meter means 39, 81 and 82, the piston 52 will gradually move up along the reduced portion 53 as a pull is exerted on inner member 12. It can also be appreciated that relative longitudinal movement between 12 and 14 can be effected since 14 will be engaged with a stuck member in the well bore, or it forms part of the drill string which is stuck and which is being jarred by the present invention.

When the piston 52 and ring 56 thereon reaches the enlarged part of cylinder portion 41, a sudden release will be effected between the inner part 12 and outer part 14 thus enabling the shoulder means 12*b* and 14*b* to impact and apply an upward jar to the drill string in which the present invention is employed.

Quite often during drilling operations due to well bore depth or possibly due to repeated use of the present invention the temperature of the hydraulic fluid employed with the hydraulic jar will increase. This will change the operating characteristics of the tool and to overcome this the orifice means 85 is constructed to provide a substantially uniform rate of flow through passage 88*a* regardless of change in fluid characteristics due to its temperature change. This is accomplished by forming member 86 and member 88 of materials having different coefficients of expansion so that as the temperature of the hydraulic fluid changes, the size of opening 88*a* will change and maintain the flow rate of the fluid therethrough substantially uniform regardless of temperature. For example, the member 86 may be formed of carbide in a manner well known in the art and a material of a different coefficient of expansion such as aluminum, bronze or steel employed for the member 88. Since the carbide insert has a different coefficient of expansion from the metal cylindrical member 88, the size opening 88*a* formed therebetween will vary in response to temperature changes of hydraulic fluid or liquid employed with the tool to maintain a substantially constant fluid flow rate.

It can be appreciated that the hydraulic jar means 70 illustrated in FIG. 6 of the present invention is identical in structure and function to that described with regard to the hydraulic jar means 50 as previously noted, except that it is reversed in position on member 12.

The overloading valve arrangement referred to at 90 in FIG. 7 provides a safety feature in the event that the piston in engagement with the reduced portion of the cylinder creates a hydrostatic pressure greater than a predetermined amount of the failure rating of the tool, the check valve 97 will open thereby discharging fluid from the cylinder portion 41 on one side of the piston means 52 to the other side of the piston means in the cylinder as shown in FIGS. 1 and 4.

The specific details of a form of a mechanical jar which may be employed with the present invention are described in our copending application Ser. No. 571,093 now U.S. Pat. No. 3,963,081 hereinabove referred to, and it will be noted that one way acting coupling means is referred to generally at 62 and is carried by the outer housing or portion 14 as shown in FIG. 1 of the drawings. Coupling engaging means are referred to generally at 63 and is shown as being carried on the inner part or mandrel 12 for engagement with the one way acting coupling means 62 carried by the housing for imparting a jar to the well string in a downward direction as will be described in greater detail hereinafter.

The one way acting coupling means 62 comprises sleeve means or one way acting sleeve collet means 64 which are constructed and arranged as shown in our prior copending application for patent above referred to. Spring means 64*a* abut the sleeve collet 64 to enable the coupling engaging means 63 to move readily through coupling means 62 when a jar is not being delivered to the drill string. Also, the spring 64*a* enables sleeve collet to be adjusted in a manner as described in our copending application whereby predetermined jarring loads may be applied to the drill string.

The coupling engaging means 63 is provided with surface means adapted to be engaged with surface means on the one way acting sleeve collet means 64 upon downward relative longitudinal movement between the inner part 12 and outer part 14 to initially frictionally engage means 63 and means 64 together so that upon applying a predetermined downward force to the well string and the part 12, the engaging means will be forced through and beyond the one way acting coupling means 62 whereupon the shoulder means 12*a* and 14*a* will impact and provide a downward jar to the drill string in which the present invention is mounted.

It will be noted that when the inner part 12 is moved longitudinally upward, the one way acting sleeve collet means 64 is constructed and arranged to enable the coupling engaging means 62 to move readily therethrough.

Figure 8:
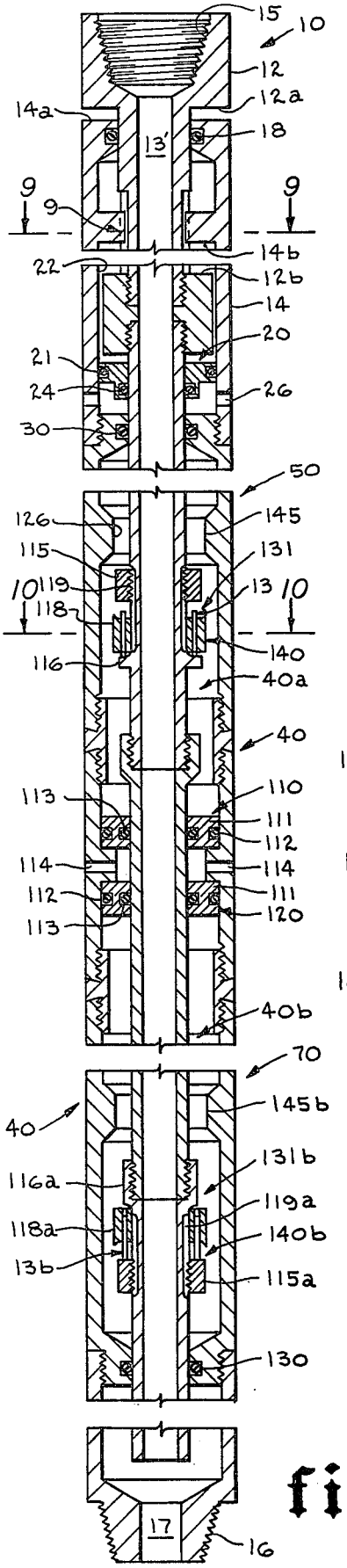
FIG. 8 is a sectional view of the preferred embodiment of the invention.

In FIG. 8 another embodiment of the hydraulic form of jar means is illustrated by the numeral 10. It includes a hydraulic up jar means 50 and hydraulic down jar means 70. An inner part or mandrel 12 extends telescopically within and longitudinally of the outer part or housing 14, as previously described. Threads 15 are provided at one end and at 16 at the other end of the device 10 for engaging it in a well or drill string. The inner member 12 includes a longitudinal bore 13' which communicates with the opening 17 at the lower end of the outer member 14.

Suitable seal means 18 are provided adjacent the upper end of the outer housing 14 for sealably engaging between the outer part 14 and inner part 12 to inhibit entry of well fluids into the tool 10 and to seal off hydraulic fluids within the tool from well bore fluids. A floating piston seal means 20 is provided with a seal 21 which engages the inner annular wall 22 of the outer part 14 in the chamber portion 23 as shown in the drawings. A seal ring 24 is provided adjacent the opening 25 in the piston seal means 20 and sealably engages with outer surface 34 of inner part 12 as shown in FIG. 8 of the drawings. Port means 26 in the outer part 14 are provided for communicating well bore fluid internally of the chamber 23 to act on the floating piston seal means 20 so that the internal pressure within the tool 10 and well bore pressure may be equalized without commingling of well bore fluids and fluids in the tool.

The inner part 12 and outer part 14 are movable longitudinal relative to each other but are restrained against relative rotation by reason of the spline arrangement referred to generally at 9, which includes a plurality of circumferentially spaced grooves 10*a* on the outer housing or part 14 in which are engaged a plurality of longitudinally extending ribs 11 extending longitudinally of the inner part 12.

The inner part 12 is provided with shoulder means at 12*a* and 12*b* and the outer part 14 is provided with shoulder means at 14*a* and 14*b*. When a downward jar is applied to the drill string or well string the shoulder means 12*a* and 14*a* will be impacted to deliver the downward jar and when an upward jar is delivered to the well string or drill string by the present invention the shoulder means 12*b* and 14*b* will be impacted to deliver an upward jar to the stuck rotary string or stuck well string in which the present invention is employed.

The seal means 30 along with the seal means referred to generally at 110, 120, and 130 form chamber means referred to generally at 40 for receiving a hydraulic actuating fluid therein. In this form of the invention it will be noted that the seal means 30 and the seal means 110 cooperate to form a first chamber referred to generally at 40*a* and the seal means 120 and 130 cooperate to form a second separate chamber means referred to generally by the numeral 40*b*. Each chamber 40*a* and 40*b* is adapted to receive and confine hydraulic actuating fluid therein. The first fluid chamber 40*a* is provided with fluid meter means for restraining relative longitudinal movement of the inner and outer tubular members 12 and 14 respectively to an extended position, such fluid meter means being operable after a predetermined relative longitudinal movement between the tubular members 12 and 14 to release them for subsequent unrestrained relative longitudinal movement until the jarring surfaces 12*b* and 14*b* engage and deliver an upward jar to the drill string.

Similarly the second chamber means 40*b* is provided with fluid meter means for restraining relative longitudinal movement of the tubular members 12 and 14 to a telescoped position, the fluid meter means being operable after a predetermined relative longitudinal movement between the tubular members 12 and 14 to release them for subsequent unrestrained relative longitudinal movement until the jarring surfaces 12*a* and 14*a* engage to deliver a downward jar to the well string.

The fluid meter means in the first chamber 40*a* is a hydraulic jar referred to generally by the numeral 13 and the fluid meter means in the chamber 40*b* is the hydraulic jar means referred to generally at 13*b*. More specifically the hydraulic jar means 13 includes a first piston means referred to generally at 140 and a first annular restriction referred to at 145 which is positioned in the first chamber 40*a* between the ends thereof. The hydraulic jar means 13*b* includes the second piston means referred to generally at 140*b* and the second annular restriction referred to generally at 145*b*. As will become apparent the construction of the first and second piston means 140 and 140*b* is the same and the configuration of the first and second annular restriction means 145 and 145*b* is generally the same. The first piston means 140 and the second piston means 140*b* each include fluid meter means and such piston means cooperate with its respective annular restriction in the chamber in which each piston and restriction is positioned in a manner generally similar to that described with regard to FIGS. 4 and 5.

The construction and arrangement of the first piston means 140 will be described in detail, and as noted previously the construction and arrangement of the second piston means 140*b* is identical thereto. Such first piston means 140 includes a collar 115 which is secured on the inner tubular member 12 in any suitable manner as shown. Spaced longitudinally therefrom is the annular shoulder 116 on the inner member 12, the collar 115 and the annular shoulder 116 limiting the longitudinal movement of the first annular piston 118 therebetween. The piston 118 is slidably arranged on the inner member 12 as shown in FIG. 8, and it will be noted that longitudinally extending, circumferentially spaced fluid bypass grooves 119 extend on the portion of the inner member 12 between the collar 115 and the annular shoulder 116. The grooves 119 terminate at one end at the annular shoulder 116 and extend beyond and under the collar 115 at their other end as shown. The piston 118 includes passages 121 therethrough in which are slidably received the pins 122. The pins 122 are of smaller diameter than the passage 121 through the piston 118 so that an annular restricted flow or metering passages 123 are formed therebetween.

The pin 122 is of different material from the piston 118 and each has a different coefficient of expansion so that temperature changes in the hydraulic fluid will act on each and function as described with regard to the members 86 and 88 of the FIG. 5 form of the invention.

Figure 11:
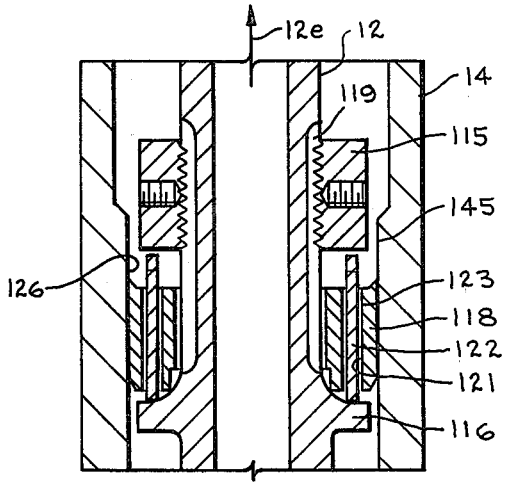
FIG. 11 is an enlarged sectional view illustrating a form of the piston means and fluid meter means with the components of the fluid meter means in position for restricting fluid flow.
Figure 13:
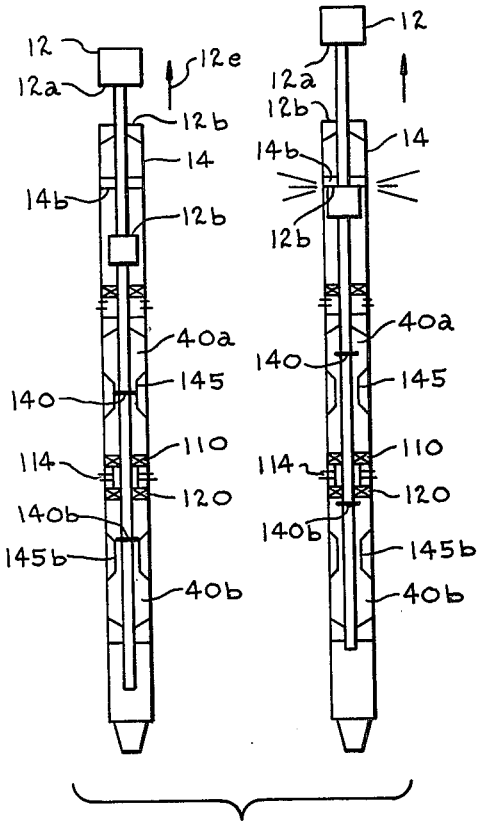
FIG. 13 is a diagrammatic view illustrating the components of the invention being moved to deliver an upward jar only.

As the inner member 12 is moved to an extended position relative to the outer member 14 as illustrated by the arrow 12e on FIGS. 11 and 13, the piston 118 will be positioned adjacent the first annular restriction 145. As this occurs the outer surface of the piston 118 slidably engages the annular surface 126 of the first annular restriction means 145 as shown in FIG. 11 of the drawings. The diameter of the first piston means 118 relative to the diameter of the first annular restriction means is such that the piston means 118 is forced down into engagement with the annular shoulder 116 to close off fluid flow through the longitudinal fluid bypass grooves 119 as long as the piston 118 is slidably engaged with first annular restriction 145. Upward movement of the inner member 12 relative to the outer member 14 causes fluid to flow through the restricted annular opening, or metering passage 123 between the pins 122 and the openings 121 in the piston while the first piston 118 is slidably engaged with first restriction means 145. The restriction of the flow of the hydraulic fluid in the first chamber means **40*a* from above the piston 118 to beneath the piston 118 by such arrangement causes a tension load and stretching of the drill string in which the inner member 12** is connected as previously described herein.

When the piston 118 is pulled upwardly out of the first annular restriction means 145, piston 118 enters the enlarged chamber bore in chamber **40*a* so that fluid flows unrestrictedly around piston 118 from the top of chamber 40*a* above the piston 118 to the chamber 40*a* beneath piston 118. Thus, the flow of hydraulic fluid is suddenly released from the top of the piston 118 in the first chamber means 40*a* to the bottom of chamber 40*a* beneath the piston means to accommodate unrestrained relative longitudinal movement between the members 12 and 14. This causes the member 12 to move up rapidly so that the jarring surfaces engage as diagrammatically illustrated in FIG. 13** to deliver an upward jar to the well string in which the tool is connected.

During the upward movement of the inner member 12 relative to the outer member 14 to deliver an upward jar to the well string, the second piston **118*a* forming part of the second piston means 140*b* is moved downwardly against the collar 115*a* and hydraulic fluid in the second chamber means 40*b* may flow unrestricted from above the piston 118*a* through the grooves 119*a* to the chamber beneath the piston 118*a*. Thus the second piston means 140*b* and second restriction means in the second chamber means 40*b* do not restrict relative longitudinal movement of members 12 and 14 as 12 is moved upwardly relative to 14**.

Figure 12:
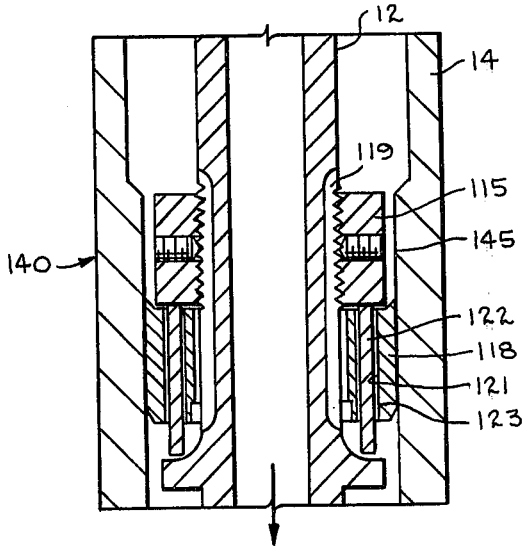
FIG. 12 is a sectional view similar to FIG. 11 illustrating the relationship of the components of the fluid by pass means when the fluid by pass means is not restricting fluid flow.

Similarly, when the first piston 118 is moved downwardly through the first annular restriction 145 in the first chamber **40*a*, fluid flow around and under the first piston 118 is readily accommodated through grooves 119 so that the first piston means 140 may move unrestrictedly downwardly through the first annular restriction means 145 without building any tension or compression load in the inner member 12. Attention is directed to FIG. 12 which illustrates the movement of the first piston means 140 down through the first restriction means 145. As can be seen, the first piston 118 is moved up against the lower end of the collar 115 and fluid flow may readily occur from beneath the piston 118 in the chamber 40a through the longitudinal grooves 119 to be discharged above the piston 118 and collar 115. Thus the first piston means 140 allows unrestrained relative longitudinal movement between the inner member 12 and outer member 14 as the inner member 12** moved downwardly.

Figure 14:
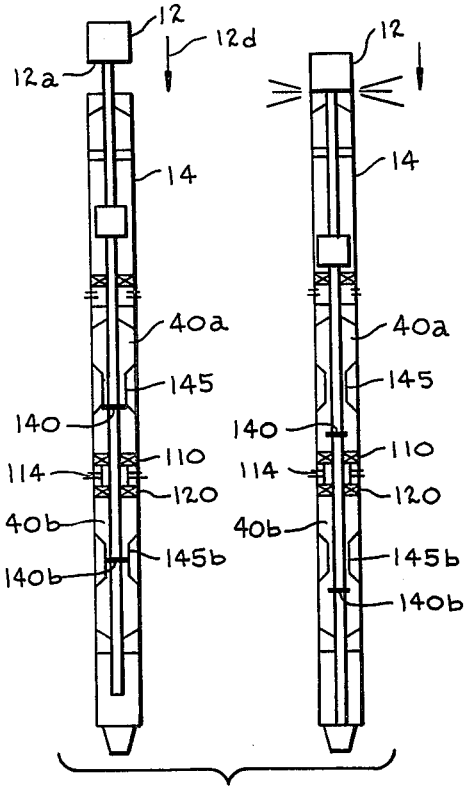
FIG. 14 is a diagrammatic view illustrating the components of the invention and their relationship in moving to deliver a downward jar only.

If it is desired to deliver a downward jar to the stuck well string, the second piston means **140*b* is positioned adjacent the second annular restriction 145*b* in the second chamber means 40*b*. When the inner member 12 is then moved downwardly in the direction as indicated by the arrow 12*d* in FIG. 14, the second piston 118*a* moves upwardly against the annular shoulder 116*a* to close off flow of fluid through passages 119*a* from the second chamber 40*b* beneath the second piston 118*a* to the second chamber 40*b* above the piston 118a when piston 118*a* is slidably engaged with the second annular restriction 145*b* as 12 is moved downwardly. This causes fluid to flow through restriction or metering passages 123 in the second piston means 118a and restrains relative downward longitudinal movement of the inner member 12 with respect to the outer member 14 and places a compression load on the drill string or well string in which the present invention is connected until the piston 118*a* clears the second annular restriction 145*b* on its downward travel. As soon as the piston 118*a* has cleared the second annular restriction 145*b* and enters the enlarged chamber bore of second chamber 40*b* as the inner member 12 is moved downwardly, hydraulic fluid in the second chamber 40*b* is free to move unrestrictedly from beneath the second piston means 140*b* to thereabove in second chamber 40*b* and this accommodates unrestrained relative longitudinal movement of the inner member 12 and outer member 14 until the jarring surfaces 12*a* and 14*a* engage as illustrated in FIG. 14** to deliver a downward jar to the well string.

Since the first chamber **40*a* and the fluid restriction means therein restrict flow of fluid only as the inner member 12 is moved upwardly while at the same time the fluid restriction means in the lower or second fluid chamber is inoperative, it can be appreciated that the construction and arrangement of the present invention enables the drill string to be stretched and a tension load applied thereto as the restriction of fluid flow is created in the first chamber 40*a*, and such tension load continues until the restriction of the flow of fluid in chamber 40*a* is released, whereupon the inner member 12 and outer member 14** may move unrestrained to deliver an upward jar to the well string.

Similarly, the second fluid chamber **40*b* and the fluid restriction means formed therein operate only upon a downward movement of the inner member 12 to initially restrain relative longitudinal movement between the inner member 12 and outer member 14 and thus create a compression load in the well string while the restriction means in chamber 40*a* is inoperative to create a compression load in the well string. Such compression load continues until the restriction of the flow of fluid in chamber 40*b*** is released, whereupon the inner member 12 and outer member 14 may move unrestrained to deliver a downward jar to the well string.

Figure 15:
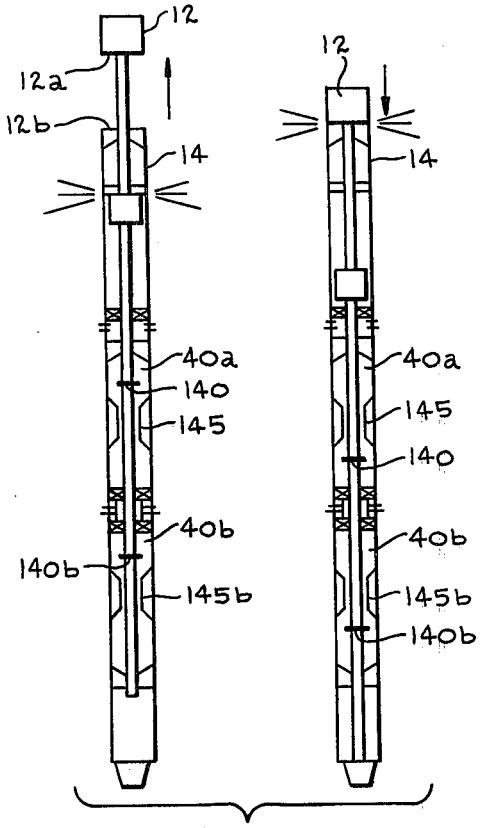
FIG. 15 is a diagrammatic view illustrating the components of the invention delivering a combination up and down jar.

FIG. 15 diagrammatically illustrates the operation of the present invention where the inner member 12 is initially moved up so as to deliver an upward jar to the drill string and is thereafter moved downwardly to deliver a downward jar to the well string.

Figure 16:
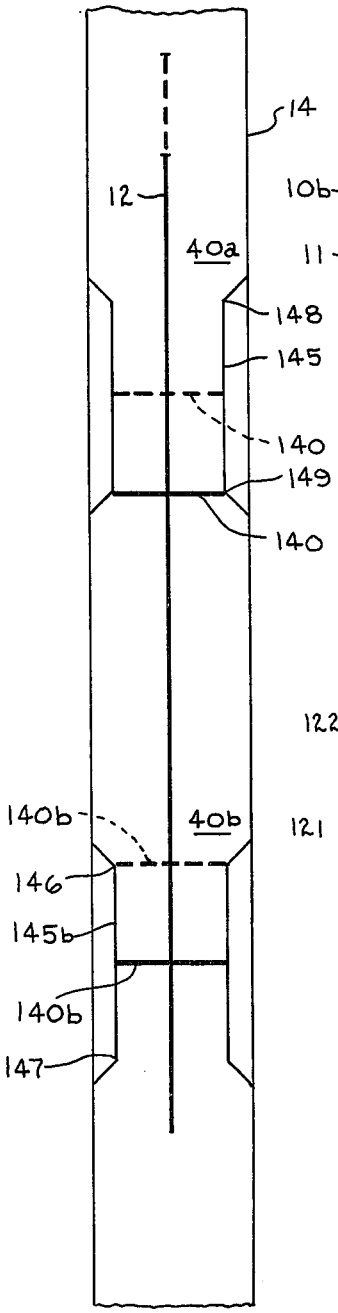
FIG. 16 is a schematic representation illustrating the spacial relationship of the components of the form of the invention shown in FIGS. 6 and 8.
Figure 9:
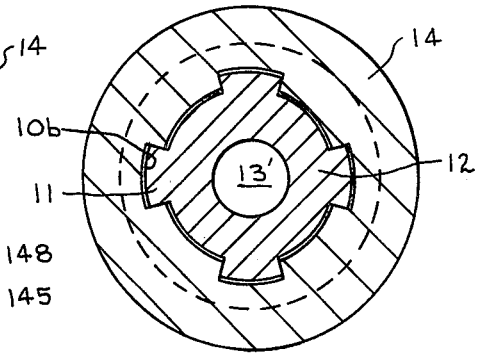
FIG. 9 is a sectional view of the line 9—9 of FIG. 8.
Figure 10:
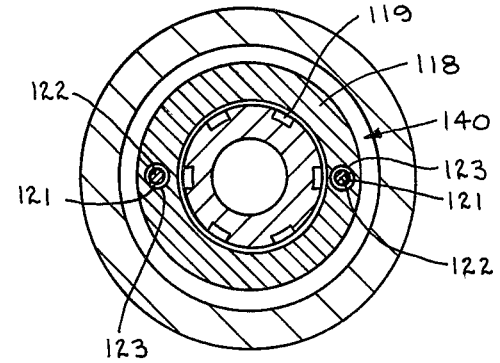
FIG. 10 is a sectional view on the line 10—10 of FIG. 8.

In FIG. 16 the inner member 12 is diagrammatically illustrated as is the outer member 14 with the first annular restriction means 145 which is positioned in the first chamber 40a and the second restriction means 145*b* which is positioned in the second chamber means 40*b*. Also the first piston means 140 is diagrammatically shown on the inner member 12 as is the second piston means 140*b*.

It can be seen from such diagrammatic representation that the first and second piston means 140 and 140*b* and the first and second annular restriction means 145 and 145*b* are spaced longitudinally relative to each other so that when either one of the piston means 140 and 140*b* enters an annular restriction so as to actuate the fluid meter means in one of the chambers to restrain relative longitudinal movement between the tubular members 12 and 14, the other piston means is between the ends of the other annular restriction.

For example, in FIG. 16 the first piston means 140 is illustrated in solid line as being positioned adjacent the end 149 to initially enter the first annular restriction means 145 as the member 12 is pulled up, and at such time it will be noted that the second piston means 145*b* also shown in solid line is between the ends 146 and 147 of the longitudinally extending second annular restriction 145*b*.

Similarly, the first piston means 140 is shown in a second position in dotted line as being between the ends 148 and 149 of the longitudinally extending first annular restriction means 145. At such time, the second piston means 140*b* is shown in dotted line adjacent the end 146 and just entering the second annular restriction 145*b* so that further downward movement of the inner member 12 will actuate the fluid meter means in the chamber to restrict the flow of fluid from beneath the second piston means 140*b* to thereabove.

In the preferred formed of the invention when the first piston means 140 is in the position shown in solid line in FIG. 16, the second piston means 140*b* will be intermediate the ends 146, 147 of the second restriction means 145*b* whereas when the second piston means 140*b* is in the position indicated at dotted line in FIG. 16, the first piston means 140 will be intermediate the ends of the first annular restriction means 145 as illustrated in dotted line in FIG. 16.

In some instance it will be desirable to vary the spacing of the first and second piston means from that described above. For example, the first piston means 140 may be positioned on member 12 so that when it is in the position shown in solid line adjacent the end 149 of the first annular restriction means 145, the second piston means 140*b* will be in the position on member 12 shown in dotted line adjacent the end 146 of the second restriction means 145*b* of FIG. 16.

Thus, the first and second annular restriction means 145, 145*b* in each the first and second chamber 40*a* and 40*b* respectively will be of the proper longitudinal extent and spaced to accomplish the foregoing.

The spacial arrangement of the first and second piston means and the first and second annular restriction means in each of the first and second chambers is very advantageous to the operation of the invention shown in FIGS. 8–16. In operation, after an upward jar has been applied to the well string in which the present invention is employed, the driller, by observing the weight on the weight indicator and by noting a predetermined increase as the inner member 12 is lowered after the upward jar has been delivered, will be able to automatically position the components of the present invention to apply an additional upward jar thereto if such is desired. For example, after the upward jar has been applied and the inner member 12 is then lowered relative to the outer member 14, a weight build up will be noted on the weight indicator when the second piston means 140*b* initially enters the second annular restriction means 145*b*. Such pressure build up will indicate to the driller that the first piston means 140 is between the ends 148 and 149 of the first restriction means 145, and in the preferred form of the invention as described herein will be intermediate, or substantially midway the ends thereof. If an upward jar is to be delivered to the well string, the driller may then move the inner member 12 upwardly in a manner as previously described to deliver a jar to the well string. If the magnitude of the jar blow applied to the well string was not sufficient, then upon lowering the inner member 12 after such jarring impact, the driller, by observing the weight indicator, may lower the second piston means 140*b* farther into the second restriction means 145*b* which in turn will position the first piston means closer to the end 149 of the first restriction means 145 so that a greater jar blow may then be imparted to the drill string on the next upward movement in a manner well known in the art.

Similarly, in applying downward jars to the well string, the amount of the jar may be varied by the driller as desired by positioning the second piston means 140*b* at a desired position between the ends 146, 147 of the second annular restrictions means 145b so that upon lowering of the inner member 12, the desired amount of downward impact may be applied to the drill string.

From the foregoing, it can be appreciated that the longitudinal extent and spacing of the first and second annular restriction means 140 and 145*b* as well as the longitudinal spacing of the first and second piston means 140 and 140*b* enables the driller to vary either the magnitude of the upward impact or the downward impact being delivered to the drill string while the present invention is in use, and without requiring it to be removed from the well bore for adjusting the internal components of the invention, or without the necessity of extraordinary manipulation of the drill string to accomplish the desired change in jar blow or magnitude.

Pistons 52, 52*a*, and reduced portions 53, 53*a* in the FIG. 6 form may also be spaced and arranged to accomplish the foregoing.

Suitable means are provided to equalize the pressure in the jar of the present invention adjacent the ends of each of the chambers 40*a* and 40*b*, and to this end it will be noted that the seal means 110 includes an annular member 111 with seals 112 and 113 thereon for engaging the outer member 14 and inner member 12 respectively to seal off therebetween. Thus, the seal means 110 is in effect a floating or movable seal as is the seal means 120 which also includes a construction similar to that described with regard to the seal means 110. It will be noted that passage means 114 are provided in the outer body between the ends of the seal means 110 and 120 and intermediate the adjacent ends of the first and second chamber means 40*a* and 40*b* so that the pressure in the adjacent ends of each fluid chambers 40*a* and 40*b* is equalized with the pressure in the well bore.

Also the pressure equalizing arrangement is between the first and second piston means 140 and 140*b* and between the first and second restriction means 145 and 145*b* which enables the pressure in the first and second chambers 40*a* and 40*b* to be equalized without interfering with the up and down hydraulic jar function of this invention. More particularly, placement of the well pressure equalizing means is adjacent the ends of the first and second chamber means 40*a* and 40*b* to provide upper and lower closed chambers in which upper and lower piston means 140 and 140*b* may respectively operate to accomplish restricted relative longitudinal movement between 12 and 14 to create a jarring force which will be substantially independent of local external pressure conditions. For example, when first piston means 140 moves upwardly to engage first restriction 145, ambient well bore pressure is communicated to act on seal means 110 to equalize the pressure in the first closed chamber 40a with the pressure in the well bore; however this does not interfere with the hydraulic up jar function of the invention. When first piston means 140 engages first restriction means 145 and as member 12 is moved upwardly relative to 14, the hydraulic fluid in first, closed chamber 40 beneath the piston 118 is at a lower pressure than the hydraulic fluid in chamber 40*a* above the piston 118 that is sealably and slidably engaged with first restriction means 145 to restrain relative longitudinal movement of 12 and 14 and thus create a jarring force. Also, the upper end of chamber 40*a* above the piston 118 and restriction means 145 is stationary and sealed off to withstand the hydraulic pressure built up as the jarring force is created.

Similarly, when the member 12 is moved down to engage second piston means 118*a* with second restriction means 145*b* in the second closed chamber 40*b*, well bore pressure is communicated to act on seal means 120 to equalize the pressure in the second, closed chamber 40*b* with the ambient pressure in the well bore; however this does not interfere with the hydraulic down jar function of the invention. When second piston means 140*b* engages second restriction means 145*b* and as member 12 is moved downwardly relative to 14, the hydraulic fluid in second, closed chamber 40*b* above piston 118*a* is at a lower pressure than the hydraulic fluid in chamber 40*b* beneath piston 118*a* that is sealably and slidably engaged with second restriction means 145*b* to restrain relative longitudinal movement of 12 and 14 and thus create a jarring force. Also, the lower end of chamber 40*b* beneath the piston 118*a* and restriction means 145*b* is stationary and sealed off to withstand the hydraulic pressure built up as the jarring is created.

From the foregoing, it is seen that the hydraulic pressure increase in each closed chamber 40 and 40*b* caused by the restrained relative longitudinal movement of 12 and 14 is confined between a piston and its cooperating restriction means at one end and the fixed, sealed chamber end, so that such pressure increase does not act on the floating seal means closing off the other end of the chamber. Accordingly, the pressure in each chamber may be equalized with ambient well bore pressure which acts on the floating seal in each chamber independently of the hydraulic pressure or restrictive force caused by restrained relative longitudinal movement between 12 and 14.

By way of further explanation, the jarring or impact force is substantially independent of the well bore pressure; however to have a resulting jarring or impact force, a restrictive force must first be created by restraining relative longitudinal movement between inner member 12 and outer member 14 which is then suddenly released so that a jarring impact results, either up or down depending upon how the tool is manipulated. At least to this extent the jarring force or magnitude is indirectly related to and created by the restrictive force which results from the restrained relative longitudinal movement of members 12 and 14. The present invention is constructed and arranged to restrain relative longitudinal movement of tubular members 12 and 14 independently of well bore pressure to create a restrictive force therebetween which when released results in a jarring force. Thus, the jar force caused by the restrained relative longitudinal movement between 12 and 14 is not limited by external well bore pressure, but is independent of such pressure.

Further attention is directed to the construction and arrangement of the present invention in that in all embodiments of the invention the components of the jarring means are retained in an inoperative or disengaged position when the drill string is either in tension or compression during rotary drilling operations.

To accomplish this, the tool is constructed and arranged so that the upward jar 50 and the downward jar (whether the downwardly acting jar means is a mechanical jar 60 or hydraulic jar 70) will be in an inoperative and disengaged position when the drill string is being rotated during rotary drilling operations and when the tool is in compression or tension. Thus, the components of the jarring means of the present invention of all embodiments are retained inoperative during drilling operations and are not engaged so that wear, damage or destruction thereof is substantially inhibited during normal rotary drilling operations.

It will be noted as shown in the drawings that the jar means 50 which functions to apply an upward jar to the well string and the downward jar means either mechanical jar 60 or hydraulic jar 70, is constructed and arranged so that the operating components thereof may move through and beyond their respective engaging components so that they may be disengaged as illustrated in FIGS. 1, 6 and 8 of the drawings during normal rotary drilling operations and while the drill string is in tension or compression.

When the tool of the FIG. 1 and FIG. 6 form is in the compressed position in the drill string, and it is desired to apply an upward jar, the upper member 12 is moved longitudinally until the piston means 52 sealingly engages in the reduced portion 53 of the cylinder portion 41. A continued upward force on the drill string and inner part 12 functions to build up pressure in the hydraulic fluid and apply a tension force or load on the drill string until the piston means 52 moves out of engagement with the reduced portion 53 so that shoulders 12*b* and 14*b* impart and deliver an upward jar to the drill string as previously described.

Similarly if a downward jar is to be applied with the form shown in FIG. 1, the inner part 12 is moved longitudinally downwardly from the tension position to engage the one way acting coupling means 62 with the coupling means 63 whereupon a predetermined further downward force on the member 12 moves the coupling engaging means 63 through and beyond the one way acting coupling means so as to enable the shoulders means 12*a* and 14*a* to impact against each other and apply a downward jar to the well string.

The invention may be employed in a drill string to apply a jarring force thereto when needed. Also, it may be employed in a production or drill string by connecting the production or drill string at one end to the threads 15. The threads 16, or a suitable grapple on the lower end of the tool, may be engaged with a stuck object in the well bore whereupon jarring action may be applied thereto as needed.

When a hydraulic jar is employed instead of a mechanical jar in the FIGS. 1–7 embodiment to apply a downward jar to the well string, the piston 52*a* as shown in FIG. 6 may be initially positioned above reduced portion 53*a* by raising inner part 12 and then inner part 12 is lowered to engage piston 52*a* with reduced portion 53*a* and build up a compressive load or force in the drill string. Continued loading of piston 52*a* by a downward force on inner part 12 will meter fluid as described with regard to jar 50 from beneath piston 52*a* around and above piston 52*a* until continued downward movement of 12 relative to 14 moves the piston 52*a* into enlarged cylinder portion 41*a* which suddenly releases the liquid flow around piston 52*a* so as to impact shoulder means 12*a* and 14*a* to deliver a downward jar to the drill string. It can be appreciated the movement of piston 52 or 52*a* in a reverse direction from that described to create a jar may be readily effected since the fluid in the cylinder is free to bypass the piston as it moves across the reduced portion 53 or 53*a*.

During normal drilling operations the tool components are positioned as illustrated in the drawings, which for all intents and purposes shows the jar as essentially closed and in an inoperative position with the hydraulic coupling means and mechanical coupling means disengaged.

Any suitable form of mechanical jar, may be employed in the present invention, and that form described herein is by way of example only.

Also, it can be appreciated that any suitable form of piston and cylinder arrangement incorporating the advantages of this invention in the overloading arrangement and automatic temperature compensating arrangement may be employed in lieu of the specific form described herein.

The foregoing disclosure and description of the invention are illustrative and explanatory thereof, and various changes in the size, shape, and materials as well as in the details of the illustrated construction may be made without departing from the spirit of the invention.

What is claimed is:

1. A hydraulic jar for incorporating in a drill string for use in a well bore comprising:

a. inner and outer telescopically arranged tubular members movable longitudinally relative to each other;

b. spaced seal means between said inner and outer tubular members forming separate first and second chambers for confining hydraulic operating fluid within each chamber;

c. jarring surfaces on said tubular members for jarring contact with each other to deliver an upward jar to the drill string;

d. longitudinally extending, annular first restriction means on one of said tubular members within the first chamber means;

e. first piston means on the other of said tubular members within the first chamber means;

f. said first piston means including fluid meter means operable when said first piston means is between the ends of said first restriction means for restraining relative longitudinal movement of said tubular members to an extended position, said fluid meter means operable after a predetermined relative longitudinal movement between said tubular members to release said tubular members for subsequent unrestrained relative longitudinal movement therebetween until said jarring surfaces engage and deliver an upward jar to the drill string;

g. additional jarring surfaces on said tubular members for jarring contact with each other to deliver a downward jar to the well string;

h. longitudinally extending, annular second restriction means on one of said tubular members spaced from said first restriction means within the first chamber means;

i. second piston means on the other of said tubular member within the second chamber means; and j. said second piston means including fluid meter means operable when said second piston means is between the ends of said second restriction means for restraining relative longitudinal movement of said tubular members to a telescoped position, said fluid meter means operable after a predetermined relative longitudinal movement between said tubular members to release said tubular members for subsequent unrestrained relative longitudinal movement therebetween until said additional jarring surfaces engage and deliver a downward jar to the drill string.

2. The invention of claim 1 including means connecting said tubular members to prevent relative rotation therebetween.

3. The invention of claim 1 wherein said first and second piston means and said first and second restriction means on said tubular members are spaced longitudinally relative to each other so that when either one of said piston means enters an annular restriction to actuate its fluid meter means for restraining relative longitudinal movement between said inner and outer tubular members, the other piston means is between the ends of the other annular restriction.

4. The invention of claim 1 wherein the longitudinal extent of each annular restriction is such that when either one of said piston means enters an annular restriction to actuate its fluid meter means for restraining relative longitudinal movement between said inner and outer tubular members, the other piston means is intermediate the ends of the other annular restriction.

5. The invention of claim 1 including means to equalize pressure in the jar adjacent an end of each said first and second chamber means with the pressure in the well bore said means being constructed and arranged to accommodate the restrained relative longitudinal movement of said tubular members for creating a jarring force independently of the well bore pressure.

6. The invention of claim 1 wherein said fluid meter means is constructed and arranged to vary in size in response to temperature changes in the hydraulic operating fluid.

7. The invention of claim 1 wherein the means to equalize pressure includes floating seal means sealably engaging said inner and outer member.

8. The invention of claim 1 wherein said piston means and said restriction means is constructed and arranged to maintain a disengaged and thus an inoperative relationship when the drill string is in tension and compression during rotary drilling operations.

9. A hydraulic jar for incorporating in a drill string for use in a well bore comprising:

a. inner and outer telescopically arranged tubular members movable longitudinally relative to each other;

b. spaced seal means between said inner and outer tubular members forming separate first and second chambers for confining hydraulic operating fluid within each chamber;

c. jarring surfaces on said inner and outer tubular members for jarring contact with each other to deliver an upward jar to stuck drill string;

d. first hydraulic jar means formed by cooperating means on said inner and outer tubular members within the first chamber for restraining relative longitudinal movement of said inner and outer tubular members to an extended position, said cooperating means operable after a predetermined relative longitudinal movement between said inner and outer tubular members to release said inner and outer tubular members for subsequent unrestrained relative longitudinal movement therebetween until said jarring surfaces engage with each other to deliver an upward jar to stuck drill string;

e. additional jarring surfaces on said inner and outer tubular members for jarring contact with each other to deliver a downward jar to stuck drill string; and f. second hydraulic jar means formed by cooperating means on said inner and outer tubular members within the second chamber for restraining relative longitudinal movement of said inner and outer tubular members to a telescoped position, said cooperating means operable after a predetermined relative longitudinal movement between said inner and outer tubular members to release said inner and outer tubular members for subsequent unrestrained relative longitudinal movement therebetween until said additional jarring surfaces engage with each other to deliver a downward jar to stuck drill string.

10. The invention of claim 9 including means to equalize pressure adjacent an end of each said first and second chamber with the pressure in the well bore, said means being constructed and arranged to accommodate the restrained relative longitudinal movement of said tubular members for creating a jarring force independently of the well bore pressure.

11. The invention of claim 10 wherein the means to equalize pressure includes:

a. movable seal means at the adjacent ends of said first and second chambers and between said first and second hydraulic jar means;

b. said movable seal means sealably engaging said inner and outer tubular members; and c. said outer member having passage means between said movable seal means for communicating well bore pressure to act on said movable seal means.

12. The invention of claim 9 including means connecting said inner and outer tubular members to prevent relative rotation therebetween.

13. The invention of claim 9 wherein said hydraulic jar means is constructed and arranged to maintain a disengaged and thus an inoperative relationship when the drill string is in tension and compression during rotary drilling operations.

14. The invention of claim 9 wherein said first and second hydraulic jar means are spaced longitudinally relative to each other on said inner and outer tubular members so that when the cooperating means of either one of said hydraulic jar means to engaged to restrain relative longitudinal movement between said inner and outer tubular members the cooperating means of the other hydraulic jar means is also engaged but does not restrain relative longitudinal movement of said inner and outer tubular members.

15. A hydraulic jar for incorporating in a drill string for use in a well bore comprising:

a. inner and outer telescopically arranged tubular members movable longitudinally relative to each other;

b. spaced seal means between said inner and outer tubular members forming separate first and second chambers for confining hydraulic operating fluid within each chamber;

c. jarring surfaces on said inner and outer tubular members for engaging with each other to deliver an upward jar to stuck drill string;

d. first fluid meter means in said first chamber for restraining relative longitudinal movement of said inner and outer tubular members to an extended position, said fluid meter means operable after a predetermined relative longitudinal movement between said inner and outer tubular members to release said inner and outer tubular members for subsequent unrestrained relative longitudinal movement therebetween until said jarring surfaces engage with each other and deliver an upward jar to stuck drill string;

e. additional jarring surfaces on said inner and outer tubular members for engaging with each other to deliver a downward jar to stuck drill string; and f. second fluid meter means in said second chamber for restraining relative longitudinal movement of said tubular members to a telescoped position, said fluid meter means operable after a predetermined relative longitudinal movement between said inner and outer tubular members to release said inner and outer tubular members for subsequent unrestrained relative longitudinal movement therebetween until said additional jarring surfaces engage with each other to deliver a downward jar to stuck drill string.

16. The invention of claim 15 including means to equalize pressure adjacent an end of each said first and second chamber with the pressure in the well bore, said means being constructed and arranged to accommodate the restrained relative longitudinal movement of said tubular members for creating a jarring force independently of the well bore pressure.

17. The invention of claim 16 wherein the means to equalize pressure in the jar includes:

a. movable seal means at the adjacent ends of said first and second chambers and between said first and second fluid meter means;

b. said movable seal means sealably engaging said inner and outer tubular members; and c. said outer member having passage means between said movable seal means for communicating well bore pressure to act on said movable seal means.

18. The invention of claim 15 wherein said fluid meter means is constructed and arranged to vary in size in response to temperature changes in the hydraulic operating fluid.

19. The invention of claim 15 including means connecting said inner and outer tubular members to prevent relative rotation therebetween.

20. The invention of claim 15 wherein said fluid meter means is constructed and arranged to maintain an inoperative relationship when the drill string is in tension and compression during rotary drilling operations.

21. The invention of claim 15 wherein said first and second fluid meter means are spaced longitudinally relative to each other so that when either one of said meter means is operable to restrain relative longitudinal movement between said inner and outer tubular members the other meter means is operable to not restrain relative longitudinal movement of said inner and outer tubular members.

22. A hydraulic jar for incorporating in a drill string for use in a well bore comprising:

a. inner and outer telescopically arranged tubular members movable longitudinally relative to each other;
b. spaced seal means between said inner and outer tubular members forming separate first and second chambers for confining hydraulic fluid within each chamber;
c. jarring surfaces on said inner and outer tubular members for engaging with each other to deliver an upward jar to stuck drill string;
d. longitudinally extending, annular first restriction means within the first chamber;
e. first piston means on said inner member within the first chamber;
f. said first piston means including fluid meter means operable when said first piston means is between the ends of said first restriction means for restraining relative longitudinal movement of said inner and outer tubular members to an extended position, said fluid meter means operable after a predetermined relative longitudinal movement between said inner and outer tubular members to release said inner and outer tubular members for subsequent unrestrained relative longitudinal movement therebetween until said jarring surfaces engage and deliver an upward jar to stuck drill string;
g. additional jarring surfaces on said inner and outer tubular members for engaging with each other to deliver a downward jar to stuck drill string;
h. longitudinally extending, annular second restriction means within the second chamber;
i. second piston means on said inner member within the second chamber; and
j. said second piston means including fluid meter means operable when said second piston means is between the ends of said second restriction means for restraining relative longitudinal movement of said inner and outer tubular members to a telescoped position, said fluid meter means operable after a predetermined relative longitidinal movement between said inner and outer tubular members to release said inner and outer tubular members for subsequent unrestrained relative longitudinal movement therebetween until said additional jarring surfaces engage and deliver a downward jar to stuck drill string.

23. The invention of claim 22 including means to equalize pressure adjacent an end of each said first and second chamber with the pressure in the well bore, said means being constructed and arranged to accommodate the restrained relative longitudinal movement of said tubular members for creating a jarring force independently of the well bore pressure.

24. The invention of claim 23 wherein the means to equalize pressure in the jar includes:

a. movable seal means at the adjacent ends of said first and second chambers and between said first and second piston means and said first and second restriction means;
b. said movable seal means sealably engaging said inner and outer tubular members; and
c. said outer member having passage means between said movable seal means for communicating well bore pressure to act on said movable seal means.

25. The invention of claim 22 wherein said fluid meter means is constructed and arranged to vary in size in response to temperature changes in the hydraulic operating fluid.

26. The invention of claim 22 including means connecting said inner and outer tubular members to prevent relative rotation therebetween.

27. The invention of claim 22 wherein said piston means and said restriction means is constructed and arranged to maintain a disengaged and thus an inoperative relationship when the drill string is in tension and compression during rotary drilling operations.

28. The invention of claim 22 wherein said first and second piston means and said first and second restriction means are spaced longitudinally relative to each other so that when either one of said piston means enters an annular restriction to actuate its fluid meter means for restraining relative longitudinal movement between said inner and outer tubular members, the other piston means is between the ends of the other annular restriction.

29. The invention of claim 22 wherein the longitudinal extent of each annular restriction is such that when either one of said piston means enters an annular restriction to actuate its fluid meter means for restraining relative longitudinal movement between said inner and outer tubular members, the other piston means is intermediate the ends of the other annular restriction.

30. In a hydraulic jar for use in a pipe string having inner and outer telescopically arranged tubular members movable longitudinally relative to each other, jarring surfaces on the inner and outer tubular members for jarring contact with each other to deliver an upward jar to a stuck string, additional jarring surfaces on the inner and outer tubular members for jarring contact with each other to deliver a downward jar to a stuck string, spaced, longitudinally extending first and second annular restrictions on one of the members, longitudinally spaced first and second pistons on the other member, the first piston including fluid meter means operable when the first piston is between the ends of the first restriction and upon movement of the inner member in one direction to restrain relative longitudinal movement of the inner and outer tubular members to an extended position, the fluid meter means being operable after a predetermined relative longitudinal movement between the inner and outer tubular members to release the inner and outer tubular members for subsequent unrestrained relative longitudinal movement therebetween until said jarring surfaces engage and deliver an upward jar to the drill string, and the second piston including fluid meter means operable when the second piston is between the ends of the second restriction and upon movement of the inner member in the other direction to restrain relative longitudinal movement of the inner and outer tubular members to a telescoped position, the fluid meter means being operable after a predetermined relative longitudinal movement between the inner and outer tubular members to release the inner and outer tubular members for subsequent unrestrained relative longitudinal movement therebetween until said additional jarring surfaces engage and deliver a downward jar to the drill string, the invention comprising:

a. spaced seal means between said inner and outer tubular members arranged to form separate first and second chambers for confining hydraulic operating fluid within each chamber, with the first piston and first restriction being in said first chamber and the second piston and second restriction being in said second chamber; and b. means to equalize pressure adjacent an end of each said first and second chamber with the pressure in the well bore, said means being constructed and arranged to accommodate the restrained relative longitudinal movement of said tubular members for creating a jarring force independent of the well bore pressure.

31. The invention of claim 30 wherein the means to equalize pressure in the jar includes:

a. movable seal means at the adjacent ends of said first and second chambers and between said first and second piston means and said first and second restriction means;

b. said movable seal means sealably engaging said inner and outer tubular members; and c. said outer member having passage means between said movable seal means for communicating well bore pressure to act on said movable seal means.

32. The invention of claim 30 wherein said first and second piston and said first and second restriction are spaced longitudinally relative to each other so that when either one of said first and second pistons enters a restriction to actuate its fluid meter means for restraining relative longitudinal movement between said inner and outer tubular members, the other piston is between the ends of the other annular restriction.

33. The invention of claim 30 wherein the longitudinal extent of each annular restriction is such that when either one of said first and second pistons enters an annular restriction to actuate its fluid meter means for restraining relative longitudinal movement between said inner and outer tubular members, the other piston is intermediate the ends of the other annular restriction.

* * * * *